US005085601A

United States Patent [19]

Buchter et al.

[11] Patent Number: 5,085,601

[45] Date of Patent: Feb. 4, 1992

[54] REDUCED INSERTION FORCE ELECTRICAL CONNECTOR

[75] Inventors: Randolph L. Buchter, Harrisburg, Pa.; Randy G. Simmons, Lewisville, N.C.

[73] Assignee: AMP Incorporated, Harrisburg, Pa.

[21] Appl. No.: 625,567

[22] Filed: Dec. 11, 1990

[51] Int. Cl.[5] ..... H01R 17/00

[52] U.S. Cl. ..... 439/660; 439/79

[58] Field of Search ..... 439/660, 78, 79, 80, 439/83, 63, 62, 676, 682

[56] References Cited

U.S. PATENT DOCUMENTS

| | | | |
|---|---|---|---|
| 3,193,791 | 7/1965 | Bock et al. | 339/176 |
| 3,793,609 | 2/1974 | McIver | 339/74 R |
| 3,818,280 | 6/1974 | Smith et al. | 317/101 DH |
| 4,200,349 | 4/1980 | Holland | 339/75 MP |
| 4,343,523 | 8/1982 | Cairns et al. | 339/59 M |
| 4,392,705 | 7/1983 | Andrews et al. | 439/79 |
| 4,636,021 | 1/1987 | Bobb et al. | 339/75 MP |
| 4,652,066 | 3/1987 | Pelzl et al. | 439/79 |
| 4,747,790 | 5/1988 | Masuda et al. | 439/60 |
| 4,752,246 | 6/1988 | Triner et al. | 439/682 |
| 4,842,538 | 6/1989 | Noschese | 439/260 |
| 4,889,502 | 12/1989 | Althouse et al. | 439/607 |
| 4,932,885 | 6/1990 | Scholz | 439/79 |
| 4,997,376 | 3/1991 | Buck et al. | 439/660 |

FOREIGN PATENT DOCUMENTS

| | | | |
|---|---|---|---|
| 1765012 | 7/1971 | Fed. Rep. of Germany | 439/682 |

*Primary Examiner*—David L. Pirlot
*Attorney, Agent, or Firm*—David L. Smith

[57] ABSTRACT

A multicontact electrical connector (2) comprises an insulating housing (4) defining a plurality of pairs of adjacent rows of contact receiving cavities (18 and 20). In the upper cavity (18) of the middle row of superposed pairs of cavities (18 and 20) is a shorter contact element (38), a longer contact element (36) being supported in the cavity (20) immediately therebelow. Each longer contact element (36) has a bowed contact surface (42) which is nearer to the mating face (12) the housing (4) than the bowed contact surface (42) of the shorter contact element (38). The contact surfaces (42) of the contact elements (36 and 38) lie in slots (6,8,10) for receiving respective contact members (74,76,78) of a mating connector (66). The contact surfaces (42) of the longer contact elements (36), which surfaces lie in the upper slot (6), are bowed in the opposite direction to the contact surfaces (42) of the longer contact elements (36), which contact surfaces lie in the middle slot (8), thereby to exert equal and opposite forces against the respective contact members (74 and 76). The contact surfaces (42) of the shorter contact elements (38) which contact surfaces are in the upper and middle slots (6 and 8) are similarly oppositely bowed. Lateral forces acting between the mating connectors (4 and 66) are thereby reduced and by virtue of the staggered arrangement of the contact surfaces (42) in each slot (6,8,10) the force needed to mate the connectors is also reduced.

9 Claims, 7 Drawing Sheets

REDUCED INSERTION FORCE ELECTRICAL CONNECTOR

BACKGROUND OF THE INVENTION

This invention relates to a reduced insertion force multi contact electrical connector having a plurality of superposed rows of contacts of a mating connector. The invention also relates to a pair of contact elements for such a reduced insertion force connector.

The concept of staggering the contact surfaces of the contact elements of a printed circuit edge connector in the mating direction of the printed circuit board, thereby to reduce the force needed to mate the circuit board with the connector is disclosed in U.S. Pat. No. 3,193,791; U.S. Pat. No. 3,818,280; U.S. Pat. No. 4,200,349; U.S. Pat. No. 4,343,523; U.S. Pat. No. 4,636,021 and U.S. Pat. No. 4,842,538. Such printed circuit edge connectors do not, however, comprise a plurality of rows of pairs of contact elements and excepting in the case of the connectors disclosed in U.S. Pat. No. 4,343,523 and U.S. Pat. No. 4,200,349 the contact surfaces of the contact elements of one row are staggered with respect to the contact surfaces of the contact elements of the other row, not only in the mating direction but also lengthwise of the connector. There is disclosed in U.S. Pat. No. 3,793,609, a zero insertion force connector in which a printed circuit board is engaged by two pairs of contact elements in each of a plurality of transverse compartments in a housing. The contact surfaces of the contact elements of each pair are offset from each other in the direction of insertion of the printed circuit board, but the contact surfaces of both the longer and the shorter contact elements lie opposite to each other. Zero insertion force is achieved by means of an actuator which cams the pairs of contact elements in each compartment apart from each other for insertion of the circuit board.

A multicontact electrical connector having a plurality of superposed rows of pairs of contact elements for mating with superposed rows of contacts of a mating connector, may comprise between 300 and 400 contact elements. It is, therefore, desirable, not only that the force needed to mate the connectors should be reduced, but that the normal force exerted against each of the individual contact elements should be as far as possible uniform.

SUMMARY OF THE INVENTION

In accordance with one aspect of the present invention, a multicontact electrical connector comprises an elongate insulating housing having a mating face extending longitudinally thereof, the housing defining the plurality of pairs of adjacent rows of contact element receiving cavities, each row extending longitudinally of the housing, the cavities of each pair of adjacent rows of cavities being arranged in pairs of superposed cavities. A first elongate contact element is supported in one cavity of each superposed pair of cavities and a second elongate contact element, which is shorter than the first contact element, is supported in the other cavity of the pair of adjacent cavities. Each contact element has a retention portion retaining the contact element in its cavity and a contact spring projecting from the cavity towards the mating face of the housing. The contact spring of each first contact element has a first bowed contact surface. The contact surfaces of the first and second contact elements in the superposed cavities of each pair are bowed in opposite directions in superposed relationship in a common plane thereby cooperating to receive a respective pair of mating contact members therebetween. The first contact surface is positioned nearer to the mating face than the second contact surface and the contact surfaces of the contact elements in the cavities of each row of cavities are all bowed in the same direction. The first contact surfaces of the first contact elements in the cavities of a plurality of said pairs of adjacent rows of cavities are oppositely bowed. The oppositely bowed first contact surfaces thus apply substantially equal and opposite contact forces to the respective mating contact members that they engage. Where the pairs of adjacent rows of contact element receiving cavities are of even number, for example two in number, then the lateral force is exerted by the first contact surfaces of the rows of longer contact elements, that is to say the first contact elements, against the mating contact members are substantially equal and opposite as are the contact forces exerted on the mating contact members by the rows of shorter contact elements, that is to say the second contact elements.

Where, however, the pairs of adjacent rows of contact element receiving cavities are of uneven number, for example three in number, the said forces are not exactly balanced out although they are minimized. Since the first contact surfaces, that is to say those of the longer contact elements are nearer to the mating face than the contact surfaces of the shorter contact elements, that is to say the second contact elements, the initial deflection of the longer contact elements by the mating contact members is substantially completed before the shorter contact elements are deflected. The mating forces are thereby minimized.

According to a preferred embodiment of the invention, each contact element has a contact tail projecting therefrom and having a tine for insertion in the respective hole in a printed circuit board, the tine extends through a separator plate which is latched to the housing in order to ensure that the contact tails remain positioned in space relationship with respect to each other.

According to another aspect of the invention, the contact elements of a pair of one piece stamped and formed contact elements for reception in respective adjacent cavities in an insulating housing, each comprise a cantilever contact spring having a bowed contact surface, the elongate intermediate portion, and a retention portion for retaining the contact element in its cavity. The contact spring is connected to one end of the intermediate portion and the opposite end of the intermediate portion is connected to one end of the retention portion. The contact spring and the retention portion of each contact element are of substantially identical configuration and dimensions but the intermediate portion of one of the contact elements is longer than the intermediate portion of the other contact element.

DESCRIPTION OF THE PREFERRED EMBODIMENT

Figure 1:
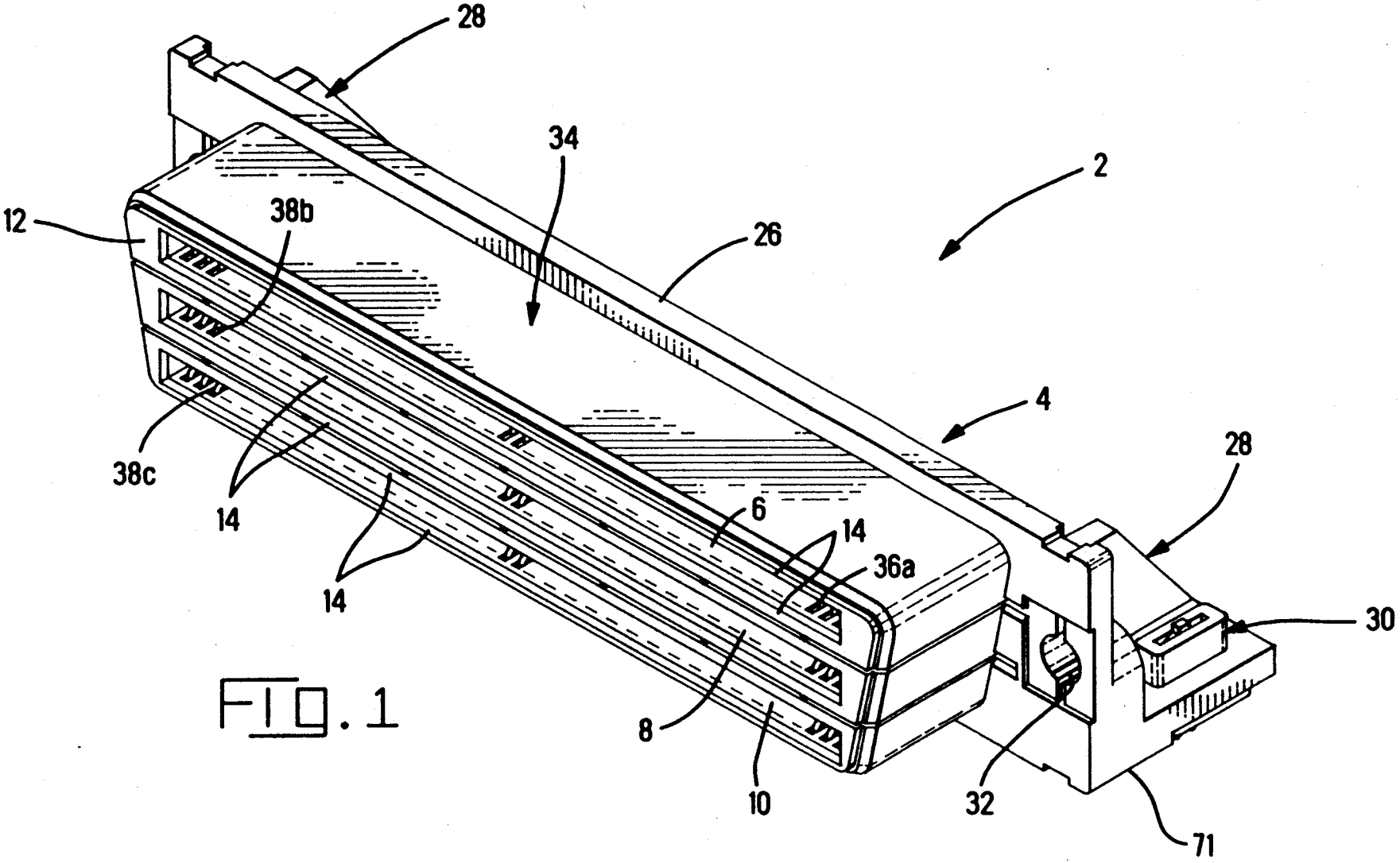
FIG. 1 is an isometric view of a board mount right-angle electrical receptacle connector according to a first embodiment of the invention, with a metal shield of the connector removed therefrom.
Figure 3:
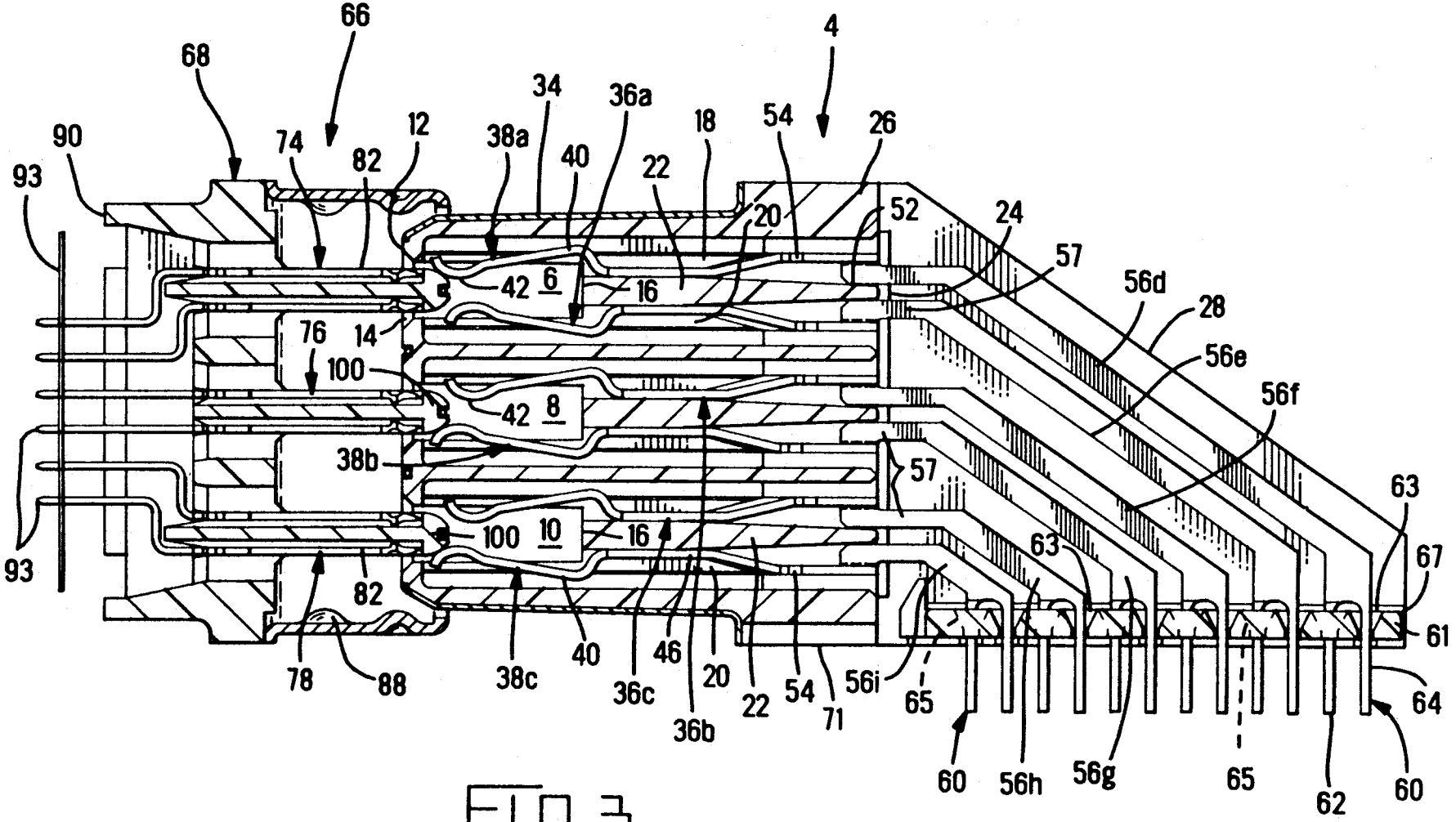
FIG. 3 is a cross sectional view of the connectors shown in FIGS. 1 and 2 in a partially mated position.
Figure 4:
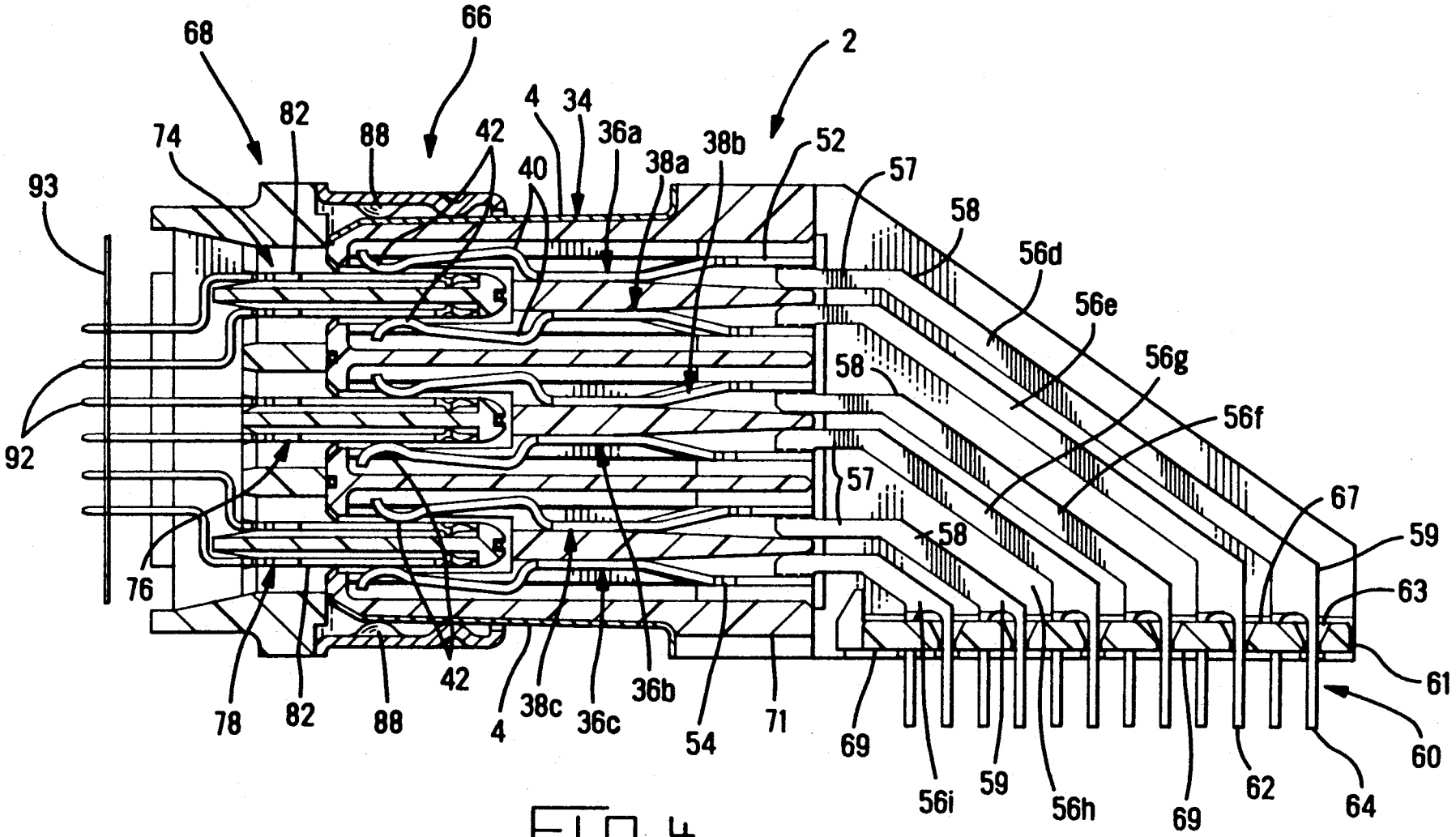
FIG. 4 is a similar view to that of FIG. 3 but showing the connectors in a fully mated position.

As shown in FIGS. 1, 3 and 4 a board mount right-angle electrical receptacle connector 2 according to the first embodiment of the invention comprises an elongate dielectric housing 4 having three superposed, parallel, longitudinally extending contact fin receiving slots 6, 8 and 10, respectively opening into a mating, forward face 12 of the housing 4, each slot 6, 8 and 10 being bounded at the mating face 12 by a pair of opposed, longitudinally extending, contact fin guide lips 14. Each slot 6, 8 and 10 which is rectangular as seen in cross section, has a base 16 remote from the face 12, communicates with a multiplicity of longitudinally extending superposed pairs of upper and lower rows of contact receiving through cavities. The cavities of the upper row of each pair are referenced 18 and those of the lower row of each pair are referenced 20. The cavities 18 and 20 of each pair are isolated from each other by an insulating barrier 22. Each cavity 18 and 20 opens rearwardly of the housing 4 into a contact element receiving face 24 thereof. The cavities 18 and 20 may, for example, be as many as three hundred or more in number. The housing 4 has a rear peripheral flange 26 from each end of which project rearwardly, a mounting lug 28 provided with boardlock 30 for securing the housing 4 to a circuit board and an opening 32 for receiving means for fastening the housing 4 to a support (not shown). As shown in FIGS. 3 and 4, the forward portion of the housing 4 is surrounded by a metal shield 34.

The connector 2 further comprises two sets of contact elements, for each vertical row of six superposed cavities 18 and 20, one set comprising three first contact elements 36*a*, 36*b* and 36*c* and the other set comprising three second contact elements 38*a*, 38*b* and 38*c*. Each contact element 36 and 38 was manufactured by stamping and forming from a single piece of sheet metal stock.

Figure 3A:
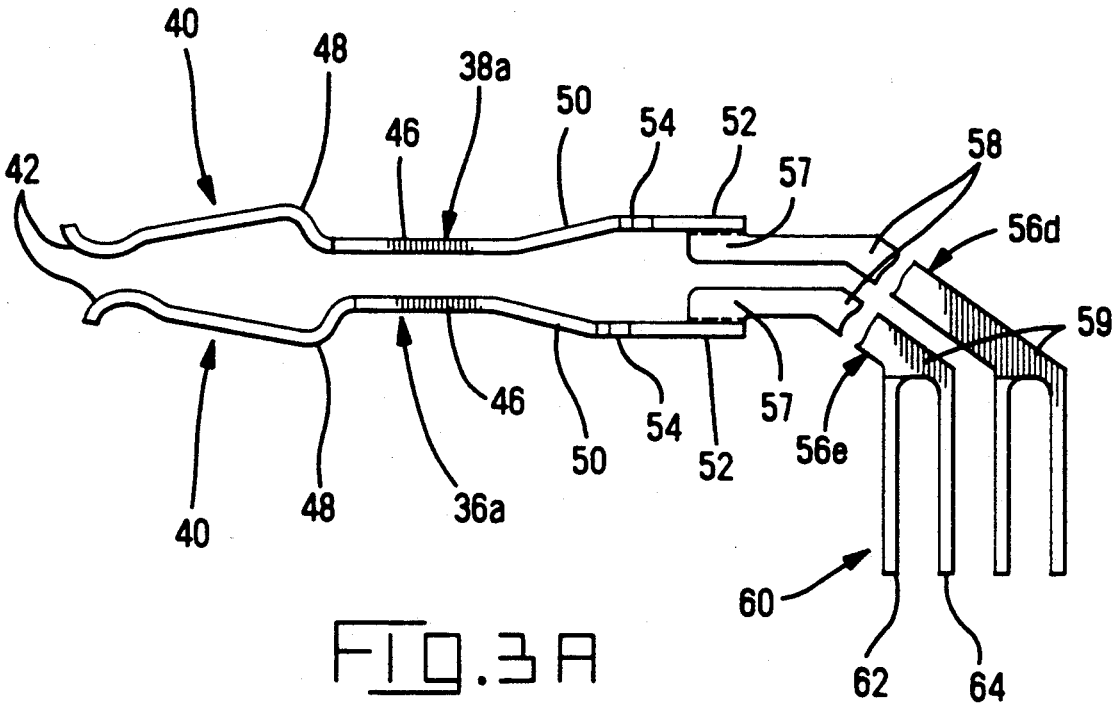
FIG. 3A is a side view of two contact elements of the receptacle connector.
Figure 3B:
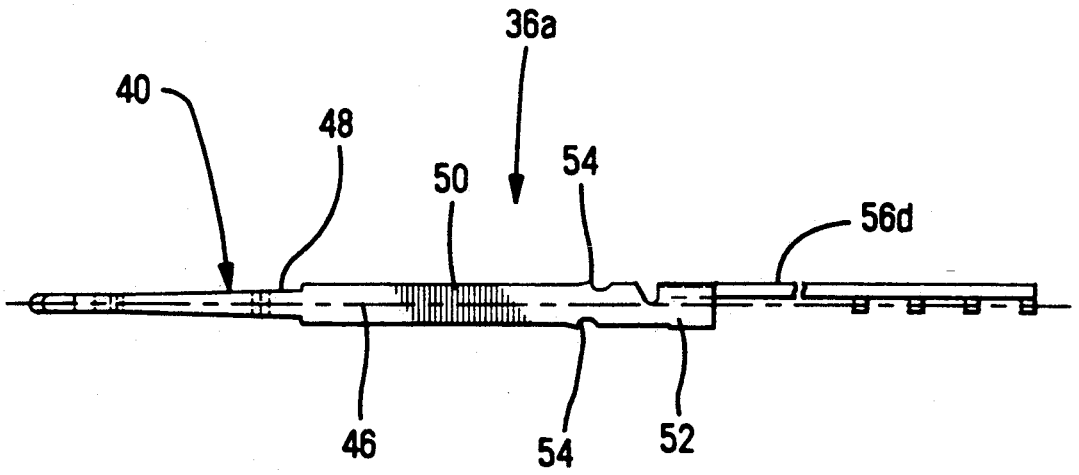
FIG. 3B is a top view of the contact elements of FIG. 3A.

The structure of the contact elements 36 and 38 will now be described in general terms with reference to the contact elements 36*a* and 38*a* which are shown in FIG. 3A and with reference to the part of the contact element 36*a* which is shown in FIG. 3B. Each contact element 36 and 38 comprises a contact spring which is generally referenced 40 and which tapers slightly in width, in the forward direction as shown in FIG. 3B. The contact spring 40, which is in the form of a cantilever, has bowed contact surface 42 proximate to its free end and is connected to one end of an intermediate portion 46 which is substantially wider than the spring 40, by way of a offset 48, the intermediate portion 46 being substantially in line with the contact surface 42. The other end of the intermediate portion 46 is connected by way of an inclined portion 50 thereof, in the case of a contact element 36, and by a declined portion 50 thereof, in the case of a contact element 38, to a rectilinear retention portion 52 having retaining barbs 54 projecting from opposite sides thereof as shown in FIG. 3B. The portion 52 is substantially in line with offset 48 as best seen in FIG. 3B. Be it noted that the portion 50 of each contact element 36 is slightly longer than the portion 50 of each contact element 38 and the retention portion 52 of each contact element 36 is correspondingly shorter than the retention portion 52 of each contact element 38. There extends from each contact element 36 and 38 a contact tail 56, the contact tails of the contact elements 36*a*, 38*a*, 38*b*, 36*b*, 38*c* and 36*c* being referenced 56*d*, 56*e*, 56*f*, 56*g*, 56*h* and 56*i* respectively, since the tails 56 extending from these contact elements are all differently configured for reasons which will be apparent from the following description. Each contact tail 56 has a forward root 57 extending from a lateral edge of the rear part of the portion 52 of the respective contact element 36 or 38, as the case may be, at right-angles to the plane thereof and parallel thereto, up to a first obtuse angled bend 58 from which the tail 56 expends obliquely and rectilinearly away from the root 57 up to a second obtuse angled bend 59 from which a bifurcated connecting part 60 of the tail 56 extends at right angles to the root 57. The part 60 initially comprises two rectilinear tines 62 and 64. Immediately prior to contact elements 36 and 38 being inserted into housing 4, one of the two tines is secured such that the tine remaining on adjacent contact elements 36 or 38 in a row of contact elements alternate, resulting in a staggered pattern. The contact elements 36 and 38 are assembled to the housing 4 by inserting them by way of the terminal receiving face 24 of the housing 4 into respective ones of the cavities 18 and 20, with the contact springs 40 of the contact elements leading, so that each contact spring 40 is received in a respective one of the slots 6, 8 and 10.

The insertion operation will now be described. A contact element 36*a* is inserted through a cavity 18 communicating with slot 6; contact element 38*a* is inserted through a cavity 20 also communicating with slot 6. A contact element 38*b* is inserted through a cavity 18 communicating with the slot 8; a contact element 36*b* is inserted through a cavity 20 also communicating with slot 8. A contact element 38*c* is inserted through a cavity 18 communicating with slot 10; a contact element 36*c* is inserted through a cavity 20 also communicating with slot 10. Be it noted that in the slot 6, each longer contact element 36*a* is positioned above a shorter contact element 38*a* and that in the slot 8, each shorter contact element 38*b* is positioned above a longer contact element 36*b*.

In the fully inserted positions of the contact elements 36 and 38, the contact surfaces 42 in each slot 6, 8 and 10 project towards one another in the same vertical plane, but in staggered relationship in the longitudinal direction of the contact elements, by virtue of the difference in length between the portions 50 and 50' of the contact elements 36 and 38, the contact surface 42 of the contact element 36 of each pair of contact elements 36 and 38, lying slightly forwardly of the opposed contact surface 42 of the contact element 38 of the pair as shown in FIGS. 3 and 4 towards the mating face 12. In said fully inserted position of each contact element, the portion 46 thereof lies flat aqainst a respective one of the barriers 22, the barbs 54 of each contact element engaging opposite side walls of the respective cavity 18 or 20, as the case may be, to retain the contact element therein. The root 57 of the contact tail 56 of each contact element extends into the rear end portion of the respective cavity 18 or 20 as the case may be. Since the root 57 of the tail 56 of each contact element extends in a plane at right-angles to that of the portion 52 of the contact element, the junction between the root 57 and the portion 52 fits snugly in the rear end of the respective cavity 18 or 20, as the case may be, thereby stabilizing the contact element in the housing 4.

The tails 56 extend from the contact elements 36 or 38, rearwardly and downwardly between the mounting lugs 28. The contact tails 56*d* to 56*i* progressively decrease in overall length in the downward direction as seen in FIGS. 3 and 4 and may be offset from the plane of root 57 to return to the centerline of the respective contact elements as shown in FIG. 3B so that the free ends of all of the tines 62 and 64 lie in the same horizontal plane, the parts 60 of the tails 56*d* and 56*i* being constantly spaced from each other in the transverse direction of the housing 4 and the tails 56 being vertically spaced from each other throughout their length. In the interest of said vertical spacing, the root 57 of the tail 56*d* is longer than that of the tail 56*e*, the root 57 of the tail 56*f* being longer than that of the tail 56*g* and the root 57 of the tail 56*h* being longer than that of the tail 56*i*. Of the tails 56*d* to 56*i*, the tail 56*d* is of the greatest length between the bends 58 and 59 thereof, the tails 56*e* to 56*i* progressively decreasing in length between the bends 58 and 59 thereof in the downward direction as seen in FIGS. 3 and 4.

The contact tails 56 are retained in the relevant positions described above, by means of the separator plate 61 which secured between the lugs 28, by means of a snapping action as taught by U.S. Pat. No. 4,080,041, the disclosure of which is hereby incorporated by reference. The plate 61 has first rows of holes 63 and second rows of holes 65, the rows extending at right-angles to the length of the housing 4, and a pair of rows of holes 63 and 65 being associated with each vertical row of contact elements 36 and 38. The rows 63 and 65 are offset from each other both in the longitudinal direction of the housing 4 and in the direction at right-angles to the length thereto resulting in a staggered pattern. As the plate 61 is assembled to the lugs 28, each tine 64 passes through a respective hole 63 guided by a funnel mouth thereof, each tine 62 passes through a respective hole 65, also guided by a funnel mouth thereof. The tails 56 are thereby, held firmly in position to maintain the true position of the distal ends thereof. The said mouths open into a tine receiving face 67 of the plate 61. Each of the tines 62 and 64 projects below a mounting face 69 of the plate 61 for insertion in appropriately positioned respective holes in a circuit board, for soldering thereto. The face 69 is substantially coplanar with a mounting face 71 of the housing 4.

A board mount vertical header connector 66 for mating with the right-angle connector 2 will now be described with particular reference to FIG. 2. The connector 66 which is described in greater detail in copending patent application Ser. Nos. 589,143 and 589,157, both filed Sept. 27, 1990, the disclosures of which are hereby incorporated by reference, comprises an insulating housing 68 having a mating forward face 70 and opposite thereto a rear face 72. Three substantially identically vertically spaced contact support fins 74, 76 and 78 respectively extend from the mating face 70 normally thereof. Extending through the housing 68 between the faces 70 and 72 is a multiplicity of contact receiving channels 80 for receiving and securing contacts 82. An electrically conductive shell 84 has a D-shaped shroud 86 extending outwardly from the mating face 70. The shroud 86 shields the contacts 82 and the fins 74, 76 and 78 and has rounded indents 88 for engaging the shield 34 of the connector 2. The housing 68 has a uniplanar mounting face 90 for reception against a circuit board (not shown) when the connector 66 is mounted thereon. Each contact 82 has a rearwardly projecting solder tail 92 proximate to which are retention barbs 94 securing contacts 82 in the housing 68. The tails 92 extend through a separator plate 93. At its forward mating end, each contact 82 has a coined, contact spring guiding, tip 96 and locating wings 98, proximate to arcuate cross section mating longitudinal edge 100 of the respective fin 74, 76 or 80. The connector 86 is elongate in a direction perpendicular to the plane FIG. 2, the fins 74, 76 and 78 being dimensioned in the longitudinal direction of the connector 66 substantially co-extensively with the slots 6, 8 and 10 respectively, of the connector 2, for reception therein as shown in FIGS. 3 and 4. The contacts 82 of each fin 74, 76 and 80 are mounted on opposite sides thereof, a contact 82 being provided for each of the contact elements 36 and 38 of the connector 2.

The mating of the connectors 2 and 66 will now be described with reference to FIGS. 3 and 4 and FIGS. 5A to 5C. As will be apparent from FIGS. 3 and 5A, the rounded edge 100 of each fin 74, 76 and 78 is inserted between the respective pair of guide lips 14 into a respective one of the slots 6, 8 or 10, as the case may be. During the insertion of the fins 74, 76 and 78, edge 100 of each fin 74, 76 and 78 engages the contact surfaces 42 of the contact springs 40 of the longer contact elements 36 of the respective longitudinal row thereof so as to deflect the contacts spring as shown in FIGS. 3 and 5B. By virtue of the opposed relationship of the contact surfaces 42 of the contact elements 36*a* and 36*b*, the forces exerted by the contact springs 40 of these contact elements against the edges 100 of the fins 74 and 76, balance out.

Figure 5A:
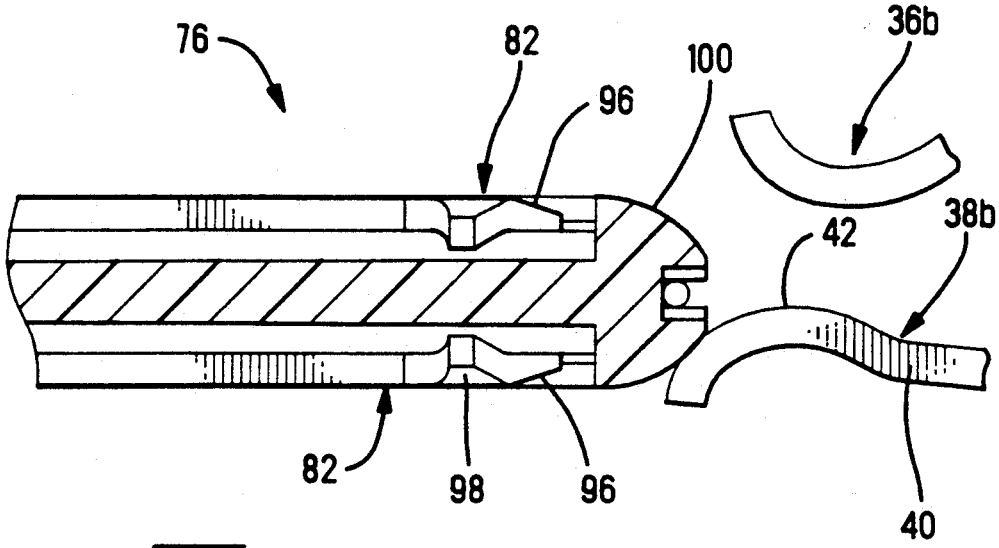
FIGS. 5A to 5C are fragmentary cross sectional views illustrating successive stages in the engagement of a contact spring of the receptacle connector with a contact fin of the header connector during the mating of these connectors.
Figure 5B:
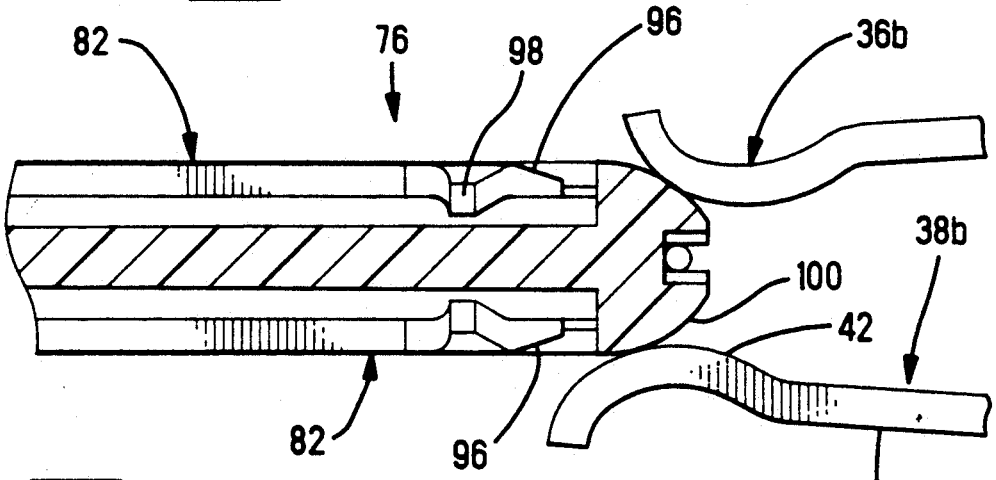
Figure 5C:
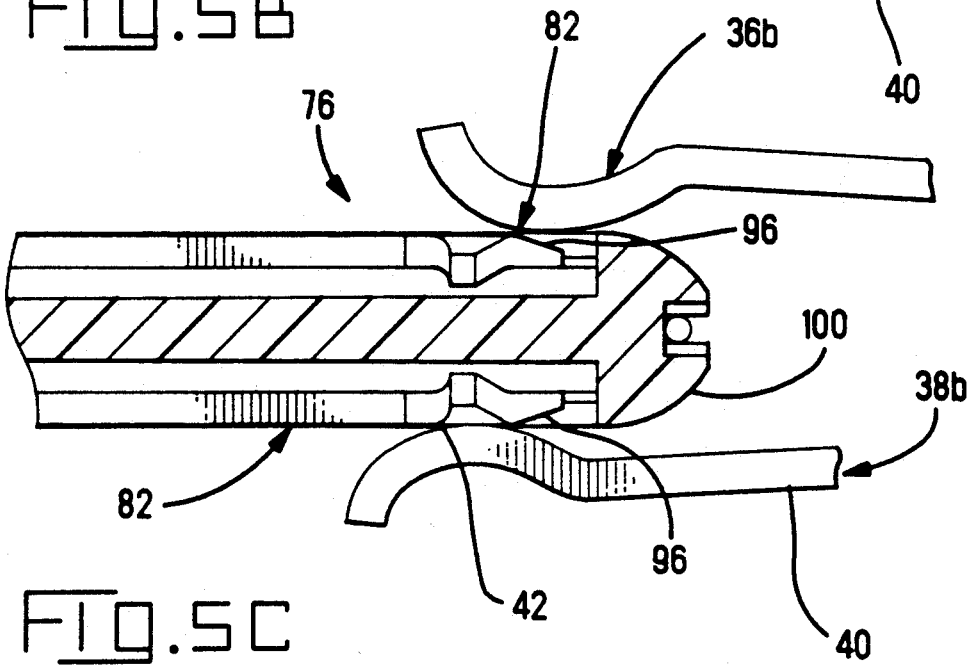

As the fins 74, 76 and 78 are further advanced into the slots 6, 8 and 10, respectively, the contact surfaces 42 of the contact elements 36 ride up the coined side tips 96 of the contacts 82 on one side of the each fin as will be apparent from FIG. 5*c*, shortly whereafter, the contact surfaces 42 of the contact elements 38 ride up the coined tips 96 of the contacts 82 on the opposite side of each fin, the forces exerted by the contact springs 40 of the contact elements 38*a*, 38*b* being equal and opposite. A uniform normal force on each of the contacts 82 is thereby assisted. The force needed to mate the connectors 2 and 66 is reduced because the forces exerted by the contact springs 40 of the contacts 36 and 38 are not applied to the contacts 82 simultaneously, but are staggered in time. This is of particular advantage because the contact elements will commonly be three hundred or more in number. After riding up the tips 96 of the contacts 82, the contact surfaces 42 slide along the contacts 82 as will be apparent from FIG. 4 which shows the connector 2 and 66 in their fully mated condition, with the indents 88 of the shroud 86 engaging the shield 34.

The sequence of FIGS. 5A through 5C show contact elements 36B and 38B being received over contact support fin 76. The interaction of contact elements 36B and 38B with fin 76 is typical of contact elements 36 and 38 with any of fins 74, 76 or 78.

Figure 2:
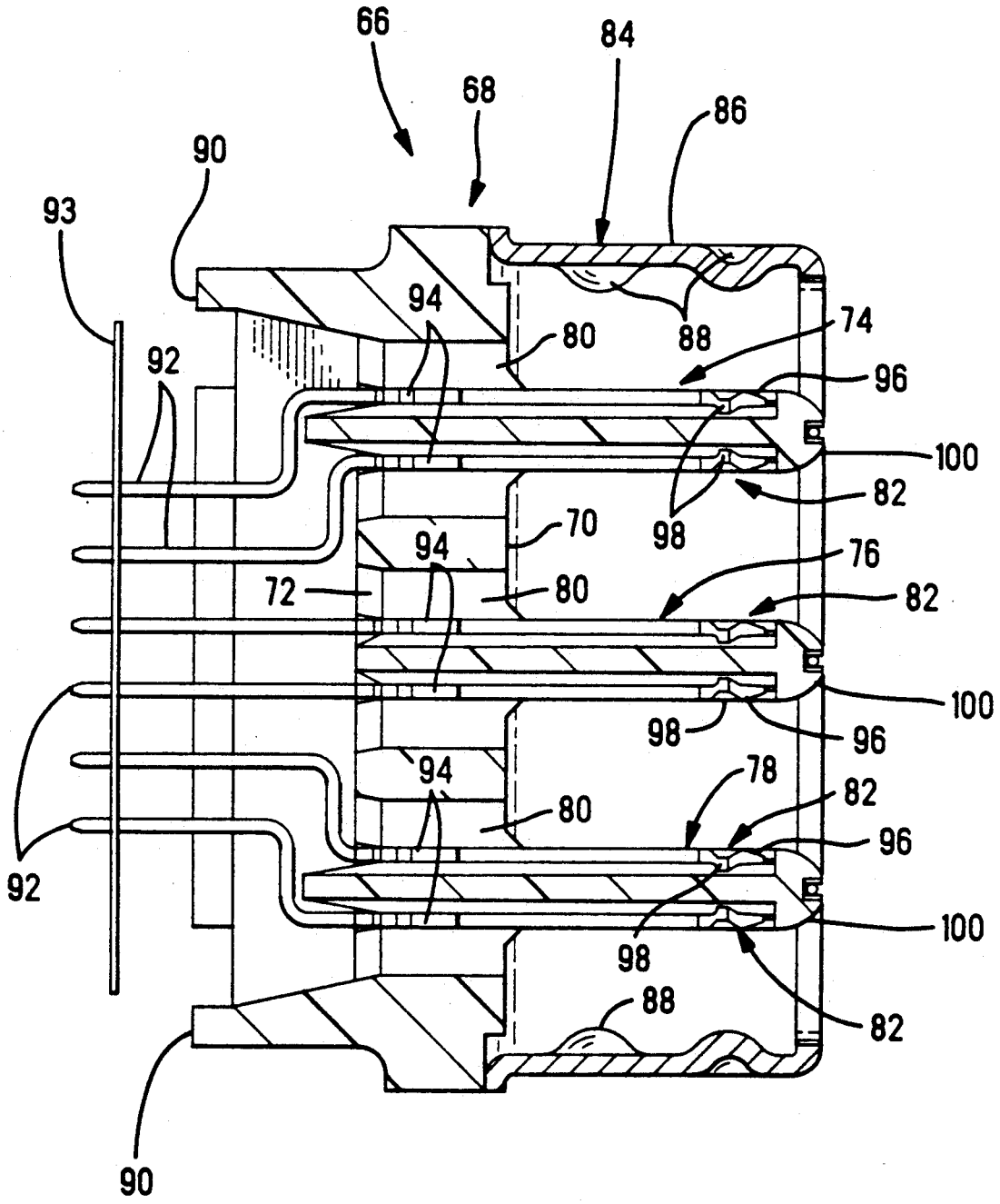
FIG. 2 is a cross sectional view of a board mount vertical header connector for mating with the connector shown in FIG. 1.

It can be seen from FIG. 2 and the sequence of FIGS. 5A through 5C that during mating of connectors 2 and 66, contact elements 38 engage and react with rounded edge 100 first. FIGS. 2 and 5A show the two connectors aligned for mating and positions that contact elements 38 just touch the respective contact support fin. Continued relative motion of connectors 2 and 66 toward each other in a manner to mate causes contact surface 42 of contact element 38 to react with rounded edge 100 which causes contact element 38B to deflect downward, contact element 38A to deflect upward and contact element 38C to also deflect downward.

With continued movement of connectors 2 and 66 toward each other, contact element 36, specifically contact surface 42 thereof, initially engages a respective rounded edge 100 when contact element 38 has deflected sufficiently to ride over its respective rounded edge 100 onto a respective contact 82 as shown in FIG. 5B.

Continued movement of connectors 2 and 66 toward each other causes contact element 38 to wipingly slide along a respective contact 82 while simultaneously contact surface 42 of contact element 36 reacts with rounded edge 100 causing contact element 36B to deflect upwardly, contact element 36A to deflect downwardly and contact element 36C to deflect upwardly.

In this manner, the mating force required to mate connectors 2 and 66 is reduced compared to what the mating force would be if all contact elements 36 and 38 simultaneously engaged and reacted with rounded edge 100 as well as deflected due to the reactionary forces. The staggered position of contact surfaces 42 along the length of contact elements 36 and 38 causes a corresponding staggered engagement and reaction of contact elements 36 and 38 with rounded edge 100 which distributes the insertion force over a greater distance than otherwise, thereby reducing the maximum insertion force experienced to mate connectors 2 and 66. This is particularly important due to the large number of contact elements 36 and 38 in connector 2 that mate with a corresponding contact 82 in connector 66.

During mating of connector 2 with connector 66, the vertical (as seen in FIG. 3) component of the reactionary forces that cause each contact 38B to deflect downwardly is substantially equal to and substantially opposite in direction to the vertical component of the reactionary forces that cause each contact 38A to deflect upwardly. The reactionary forces on contact elements 38A and 38B act simultaneously with the net result of vector addition to zero, or in other words are balanced and in this case cancel.

Similarly, although at a later point in the mating of connectors 2 and 66, the vertical (as seen in FIG. 3) component of the reactionary forces that causes each contact 36B to deflect upwardly is substantially equal to and substantially opposite in direction to the vertical component of the reactionary forces that cause each contact 36A to deflect downwardly. The reactionary forces on contact elements 36A and 36B act simultaneously with the net result of vector addition to zero, or in other words are balanced and in this case cancel.

In this manner, the reactionary forces transverse to the rows of contacts for a connector having contact elements 36A, 36B, 38A and 38B cancel each other such that the net reactionary vertical force is zero. With the presence of contacts 36C and 36D, while the net reactionary forces transverse to the rows of contacts during mating may not be zero, at least they are minimized.

Figure 6:
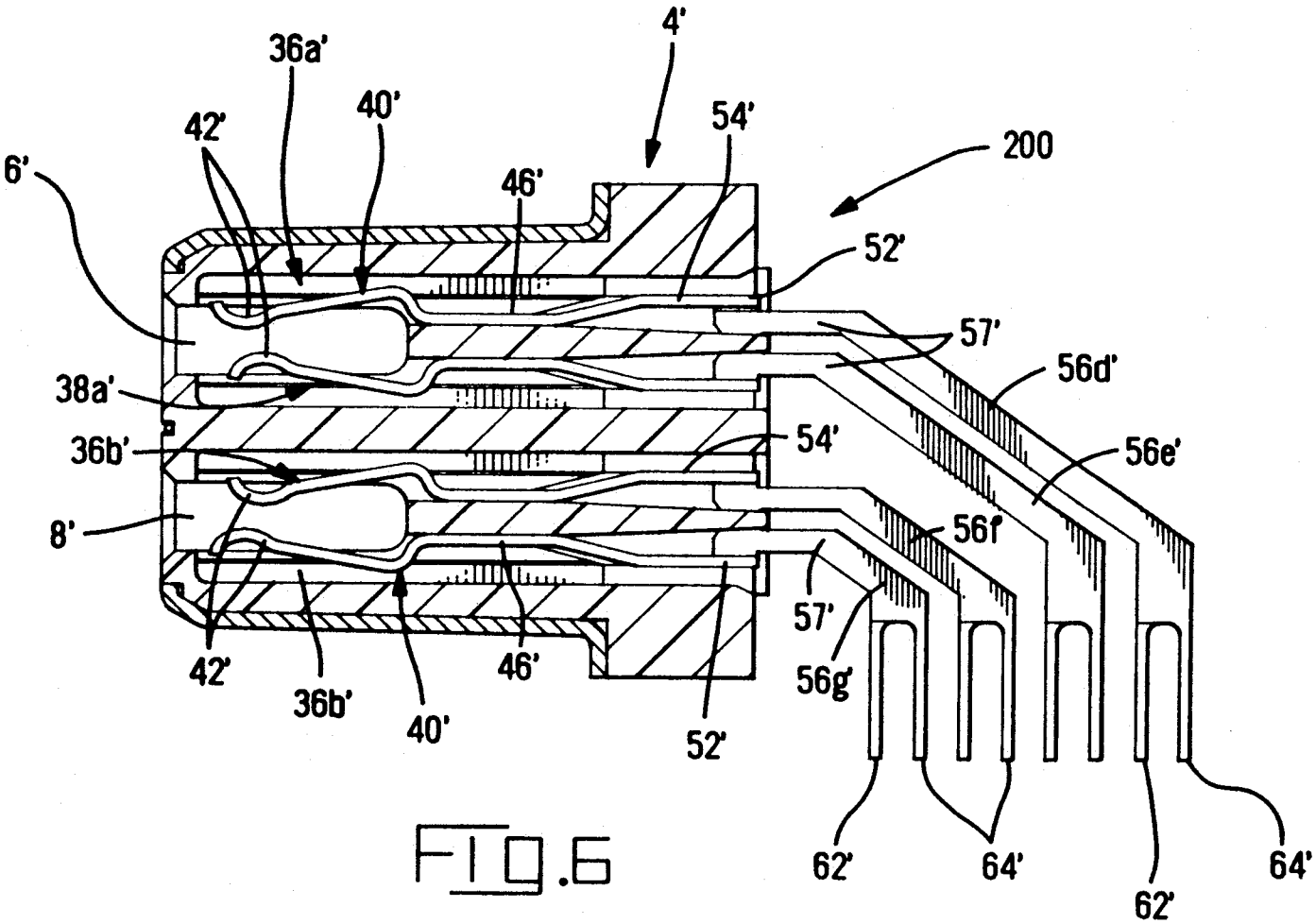
FIG. 6 is a cross sectional view of a board mount right-angle electrical receptacle connector according to a second embodiment of the invention.

The second embodiment of the invention will now be described with reference to FIG. 6 in which those parts which have a similar function to corresponding parts described above with reference to FIGS. 2 and 4, bear the same reference numerals, but with the addition of a prime symbol.

The connector 200, of the second embodiment, comprises only two slots, 6' and 8' and thus only two layers of cooperating pairs of contact elements, these pairs being referenced 36*a*' and 38*a*', 36*b*' and 36*a*', respectively. The contact elements 36*a*' and 38*a*', 36*b* and 36*a*' are arranged in the same relative orientations as the contact elements 36*a* and 38*a*, 36*b* and 38*b* described above with reference to FIGS. 3 and 4. Thus the forces exerted by contact springs of these contact elements against the fins of the mating connector, which in the present case will have only two fins, are precisely balanced out.

What is claimed is:

1. An electrical connector for mating with a complementary connector having a body, the connector comprising:

a dielectric housing having a mating face, said housing having first and second elongate substantial parallel cavities in said mating face for receiving terminals of a complementary connector, said cavities extending longitudinally of the housing and defining opposed sidewalls, each of said cavities having a first and second row of contacts secured therein, each of said rows of contacts extending longitudinally of said housing along a respective sidewall, each of the contacts in the first and second rows of said first and second cavities having a deflectable mating portion within the respective cavity proximate said mating face, the deflectable mating portion of the contacts in said first row of contacts in each of said first and second cavities being closer to the mating face than the deflectable mating portion of the contacts in said second row of contacts in each of said first and second cavities, the deflectable mating portion of each contact extending into a respective cavity away from a respective sidewall in an unbiased position, and upon reception of terminals of a complementary connector in the cavities, said contacts being biased toward said respective sidewall by a normal force between the terminals and the contacts, the deflectable mating portion of the first row of contacts of each cavity extending into the respective cavity in opposed directions, the deflectable mating portion of the second row of contacts of each cavity extending into the respective cavity in opposed directions and in each cavity in a direction opposite to the deflectable mating portion of the first tow of contacts, whereby portions of a complementary connector having terminals are receivable in the first and second cavities such that normal forces caused by the reaction between the terminals of a complementary connector and the first row of contacts in each of the first and second cavities are substantially canceled and normal forces caused by the reaction between the terminals of a complementary connector and the second row of contacts in each of the first and second cavities are substantially canceled.

2. An electrical connector as recited in claim 1, wherein the deflectable mating portion of the first row of contacts in the first cavity extend into said first cavity toward the deflectable mating portion of the first row of contacts in the second cavity.

3. An electrical connector as recited in claim 1, wherein the deflectable mating portion of the second row of contacts in the first cavity extends into said first cavity away from the deflectable mating portion of the second row of contacts in the second cavity.

4. An electrical connector as recited in claim 1, wherein the contacts in the first row of each of the first and second cavities are outermost rows of contacts in the housing.

5. An electrical connector as recited in claim 1, wherein the contacts in the second row of each of the first and second cavities are innermost rows of contacts in the housing.

6. An electrical connector as recited in claim 1, wherein the number of rows of contacts in the housing is an even number.

7. An electrical connector as recited in claim 6, wherein the number of rows of contacts in the housing is four.

8. An electrical connector as recited in claim 7, wherein the contacts in the first row of each of the first and second cavities are outermost rows of contacts in the housing.

9. An electrical connector as recited in claim 7, wherein the contacts in the second row of each of the first and second cavities are innermost rows of contacts in the housing.

* * * * *

UNITED STATES PATENT AND TRADEMARK OFFICE

CERTIFICATE OF CORRECTION

PATENT NO. : 5,085,601

DATED : February 4, 1992

INVENTOR(S) : Randolph Buchter, et al

It is certified that error appears in the above-indentified patent and that said Letters Patent is hereby corrected as shown below:

Column 8, line 57, delete "tow" and insert --row--.

Signed and Sealed this

Second Day of November, 1993

Bruce Lehman

*Attest:*

BRUCE LEHMAN

*Attesting Officer*

*Commissioner of Patents and Trademarks*